US006659763B2

(12) United States Patent
Fisher

(10) Patent No.: US 6,659,763 B2
(45) Date of Patent: Dec. 9, 2003

(54) SAFETY LIGHTER WITH RESTRICTED ACCESS TO DRIVER DISK

(75) Inventor: Gary A. Fisher, Kowloon Tong (HK)

(73) Assignee: OneWorld Enterprises Limited, Kowloon (HK)

( * ) Notice: Subject to any disclaimer, the term of this patent is extended or adjusted under 35 U.S.C. 154(b) by 91 days.

(21) Appl. No.: 10/021,211

(22) Filed: Dec. 12, 2001

(65) Prior Publication Data

US 2003/0108836 A1 Jun. 12, 2003

(51) Int. Cl.[7] ..... F23Q 2/08
(52) U.S. Cl. ..... 431/131
(58) Field of Search ..... 431/153, 277, 431/129–133, 254; F23Q 2/46, 2/02

(56) References Cited

U.S. PATENT DOCUMENTS 1,764,897 A * 6/1930 Segal ..... 431/152
1,809,548 A * 6/1931 Butler ..... 431/276
3,055,201 A * 9/1962 Smith ..... 431/150
3,213,647 A * 10/1965 Sakamoto ..... 431/131
3,277,674 A * 10/1966 Kein et al. ..... 431/150
3,286,491 A * 11/1966 Smith ..... 431/344
3,292,396 A * 12/1966 Zellweger et al. ..... 431/277
3,592,576 A * 7/1971 Hocq ..... 431/131
3,985,493 A * 10/1976 Neyret ..... 431/150
3,994,667 A * 11/1976 Takahashi ..... 431/131
4,416,612 A * 11/1983 Tabata ..... 431/131
5,401,163 A * 3/1995 Yamazaki ..... 431/129
5,759,023 A * 6/1998 Jenlis ..... 431/153
5,882,186 A 3/1999 Kai Man
6,247,920 B1 * 6/2001 Pfeil ..... 431/142

* cited by examiner

*Primary Examiner*—James G. Barrow
(74) *Attorney, Agent, or Firm*—Darby & Darby

(57) ABSTRACT

A lighter includes a housing a housing that forms a fuel reservoir. The housing has a fuel outlet extending from the housing. A valve assembly controls the flow of fuel exiting from the fuel outlet. A flint is mounted on the exterior of the housing for lighting fuel released from the fuel reservoir. A flint actuator includes a spark disk to engage the flint and a driver disk fixedly connected to the spark disk. A third disk is disposed between the driver disk and the spark disk and is freely rotatable therebetween. The third disk has a diameter greater than the driver disk. A plate is disposed between the driver disk and the housing and has a radially outwardly protruding portion between the housing and the driver disk, which is aligned with the driver disk and extends radially outwardly a greater distance than the driver disk from a central axis of the housing.

12 Claims, 3 Drawing Sheets

SAFETY LIGHTER WITH RESTRICTED ACCESS TO DRIVER DISK

BACKGROUND OF THE INVENTION

1. Field of the Invention

This invention relates to the field of lighters and, particularly, to a driver disk assembly for making a lighter more difficult to operate.

2. Discussion of the Related Art

A child typically learns by watching and mimicking the actions of an adult. Children often witness parents and other adults operating conventional lighters, which result in the creation of flames. These flames can fascinate a child, giving the child the incentive to obtain the lighter and mimic the action of the adult so as to operate the lighter. There is a great danger associated with this effort because the child is unable to appreciate and respect the power of fire. As a result, it is desirable to try to prevent the ready actuation of conventional lighters by children.

An average child has a short attention span so that the actions it mimics can easily become dissociated with an intended outcome, causing the child to abandon interest in continuing its actions. Therefore, it is an object of the present invention to provide a lighter design that hinders the ability of a child to activate the lighter, whereby the interest of the child in operating the lighter dissipates and the child moves on to other activities.

It is another object of the present invention to provide a lighter that does not significantly increase the production cost of the lighter.

It is yet another object of the present invention to provide a lighter that is more difficult for children to operate, but does not significantly hinder the ability of an adult to activate the lighter.

BRIEF DESCRIPTION OF THE INVENTION

According to the present invention, the foregoing objects are obtained with a lighter having a housing that forms a fuel reservoir. The housing has a fuel outlet extending from the housing. A valve assembly controls the flow of fuel from witbin the reservoir to the fuel outlet. A flint is mounted on a support which is mounted on a top plate of the housing for lighting fuel released from the fuel reservoir. A flint actuator includes a spark disk to engage the flint and a driver disk fixedly connected to the spark dish The spark disk and the driver disk are rotatably connected to the housing. A third disk is rotatably connected to the housing and is disposed between the driver disk and the spark disk. The third disk has a diameter greater than the driver disk. The top plate is fixedly connected to the housing. The top plate is disposed between the driver disk and the housing. The top plate has a radially outwardly protruding portion between the housing and the driver disk. The radially outwardly protruding portion is aligned with the driver disk and extends radially outwardly a greater distance than the driver disk.

BRIEF DESCRIPTION OF THE DRAWINGS

Still other objects of the present invention will become readily apparent to those skilled in the art from the following detailed description, wherein is shown and described only the preferred embodiment of the invention, simply by way of illustration of the best mode contemplated for carrying out the invention. As will be realized, the invention is capable of other and different embodiments, and its several details are capable of modifications in various respects, all without departing from the invention. Accordingly, the drawing and description are to be regarded as illustrative in nature, and not as restrictive.

DETAILED DESCRIPTION OF THE PRESENT INVENTION

Referring now to FIGS. 1–8, a lighter 10 in accordance with a preferred embodiment of the present invention is illustrated. Lighter 10 includes a housing 12, the interior of which forms a fuel reservoir. Housing 12 is preferably made of steel, but can be made of any sufficiently rigid non-combustible metal or similar material. As illustrated, housing 12 is preferably cylindrical and has a top plate 14 and a bottom plate 16 fastened to it, that are of a compatible material, for sealing in the fuel and to provide the housing with a planar surface on which to mount the various mechanisms so that the lighter can perform its intended functions.

Figure 5:
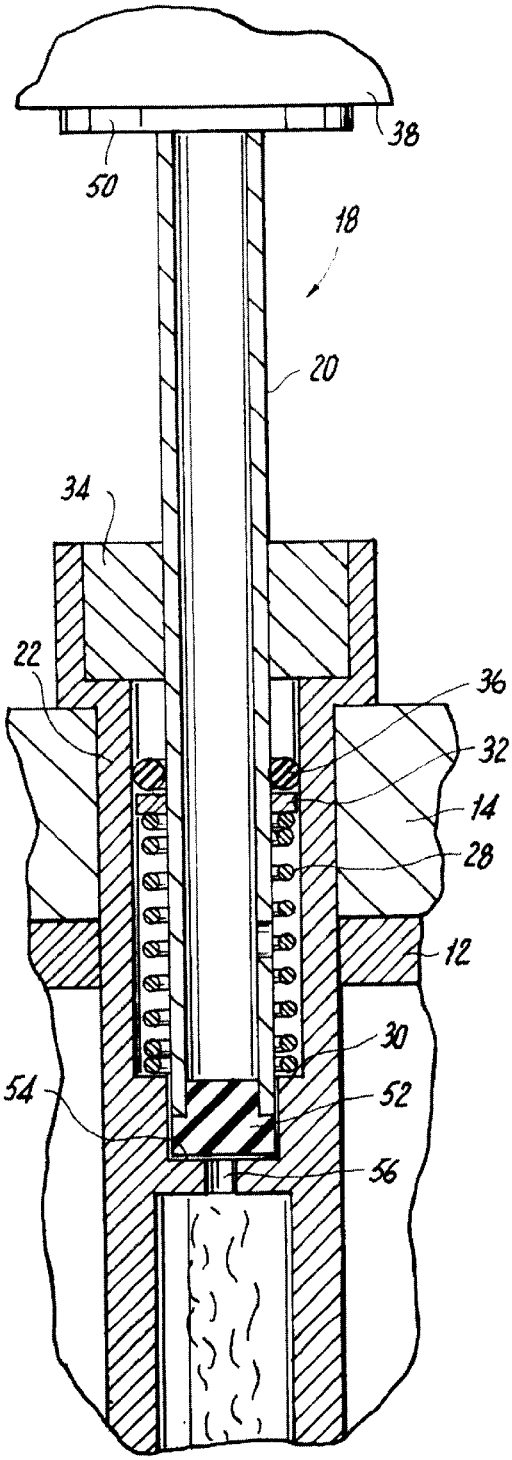
FIG. 5 is an enlarged cross sectional detail view from circle 5 of FIG. 3.
Figure 6:
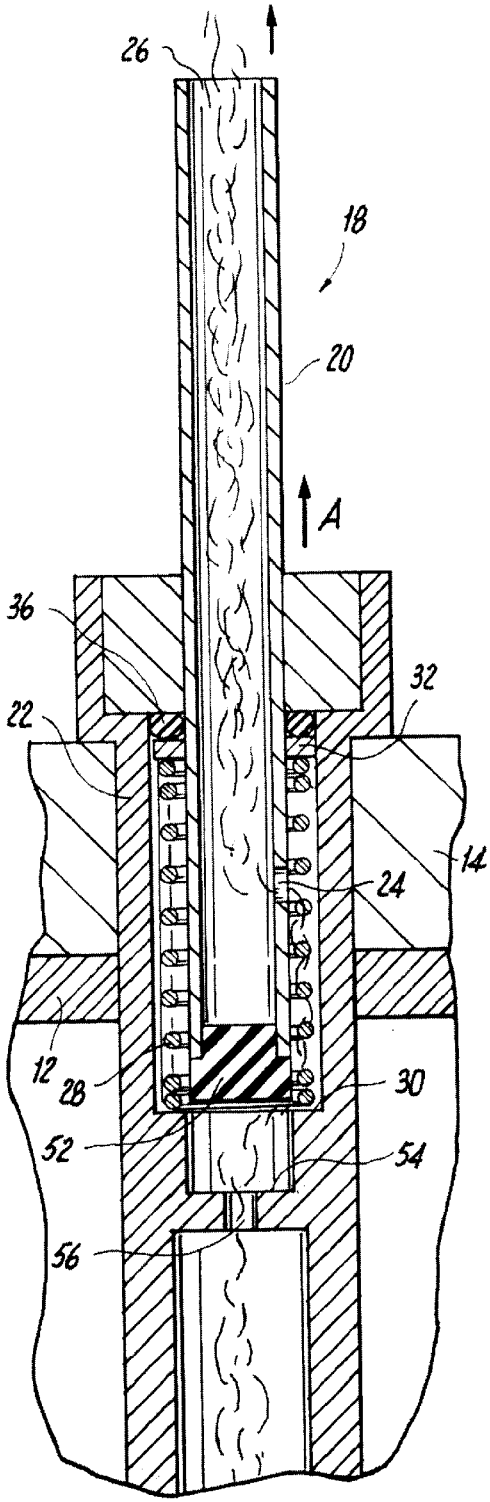
FIG. 6 is an enlarged cross sectional detail view from circle 6 of FIG. 4.

As seen if FIGS. 2–6, housing 12 has a fuel outlet mechanism 18 extending outwardly from housing 12. As shown in FIGS. 5 and 6, outlet mechanism 18 includes a smaller diameter pipe 20 axially movably located within a stationary larger diameter pipe 22. The larger pipe 22 is fixedly connected to plate 14, such as by welding. Both pipes 20 and 22 extend from within the fuel reservoir, in a direction parallel to the long axis of housing 12, through top plate 14, to the exterior of housing 12.

Pipe 20 has a hole 24 located near its bottom end (i.e., the end disposed within housing 12) for channeling fuel inside of housing 12 to the outside via exit opening 26 at the top end of pipe 20. A coil spring 28 is fitted around smaller pipe 20. Spring 28 is flanked between a step 30 in pipe 22 and a washer 32 that is fixedly mounted or otherwise fastened to the outside of smaller pipe 20. Thus, spring 28 biases small pipe 20 in an upward direction, as indicated by arrow A in FIG. 6. A seal 34 or bushing, preferably of metal, is fixedly connected to an enlarged upper end of larger pipe 22, preferably by welding. Inner pipe 20 axially slides within pipe 22, and is guided axially by bushing 34. An 'O' ring seal 36, preferably of rubber or other similar material, fits around pipe 20 above washer 30. When the lid 38 is in an open position, O-ring 36 is squeezed between bushing 34 and flange or washer 32, thereby preventing fuel from escaping around seal 36.

Figure 7:
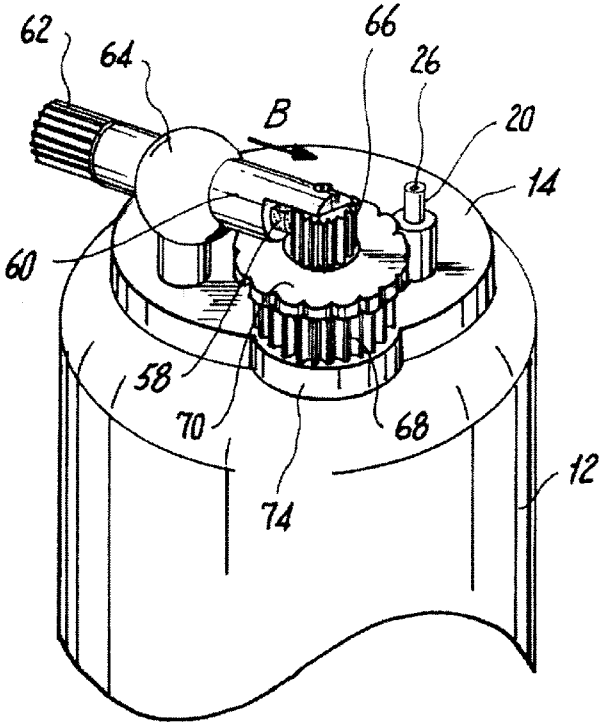
FIG. 7 is a partial perspective view of the top portion of the lighter with the driver disk exposed and the lid removed.

Lid 38 is pivotally connected to housing 12. More specifically, lid 38 has an arm 40 fixed thereto that is rotatably mounted about a pivot pin 42. Pin 42 is fixedly connected to a bifurcated post 44, which is fixedly mounted on the upper surface of top plate 14. A coil spring 46 (see FIG. 3) is depressed between plate 14 and a bottom surface 48 of arm 40 (see FIG. 8). Spring 46 maintains lid 38 in the open position of FIG. 2 or the closed position of FIG. 1, due to cam surfaces on the exterior of arm 40 at each position. The bottom of lid 38 has an actuating member 50 (see FIG. 2) that is biased outwardly by an internal coil spring 52 (see FIG. 3). Actuating member 50 is positioned within lid 38 so that, as lid 38 is closed, actuation member 50 forces smaller pipe 20 downwardly towards the closed position. When lid 38 is moved to an open position, actuating member 50 is removed from smaller pipe 20, which is then biased upwardly by spring 28, as shown in FIG. 7. The fuel contained within housing 12 is now free to vaporize and the vapors are released from the reservoir, through opening 24 into pipe 20 and out through exit opening 26, which is adjacent to a flint 58.

As described above, smaller pipe 20 moves axially within larger pipe 22 between an open position (FIG. 6) and a closed position (FIG. 5) by action of lid 38. In the closed position, lid actuator 50 moves smaller pipe 20 in a downward direction (i.e., into housing 12), whereby the connected washer 32 is moved downward, causing spring 28 to compress. A bottom seal, or plug 52, is sealingly placed in the bottom end of the base of small pipe 20. In the closed position, plug 52 presses against a step 54 in the interior of pipe 22 to seal a hole 56 to prevent communication of fuel between the reservoir and the interior of the smaller pipe 20.

In the open position of lid 38 (see FIG. 6), smaller pipe 20 is biased in the upward direction by spring 28. While open, seal 36 presses against bushing 34, thereby defining the maximum upward travel of smaller pipe 20. It will be appreciated that the top of smaller pipe 20 protrudes outwardly from the top rim of larger pipe 22 far enough so that as smaller pipe 4 moves downward, bottom seal 52 interacts with step 54 to prevent the flow of fuel as described above.

Figure 8:
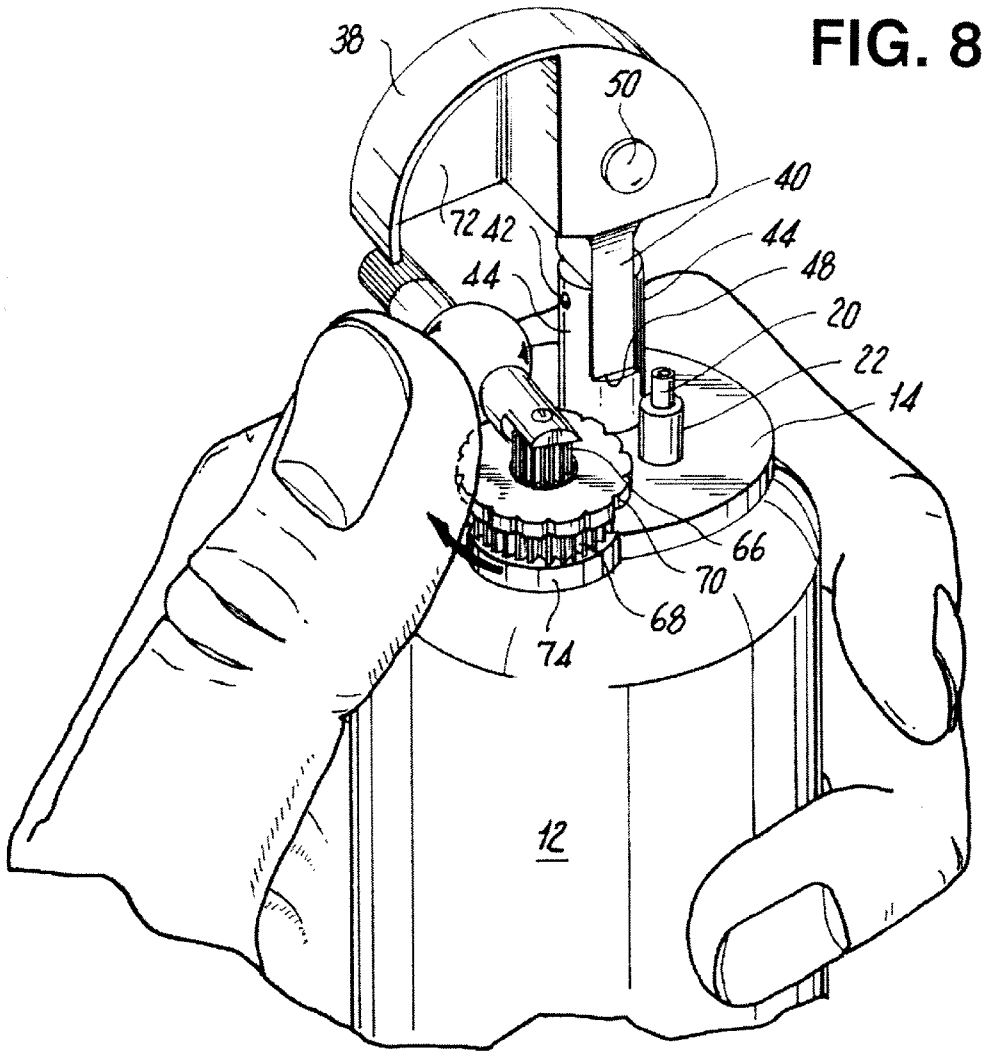
FIG. 8 is a partial perspective view of the top portion of the lighter with the driver disk exposed.

Referring now to FIGS. 7 and 8, a flint 58 is mounted to top plate 14, adjacent to outlet 26. Flint 58 is mounted on a support 60 that is movable in the direction indicated by arrow B upon the rotation of a knurled knob 62. Knob 62 has a threaded shaft (not shown) protruding therefrom and connected to support 60. The threaded shaft is received within spherical housing 64, which is fixedly mounted to top plate 14. Spherical housing 64 includes a threaded bore to receive the threaded shaft projecting from knob 62. Thus, rotation of knob 62 causes the flint 58 to advance toward or retract from a spark disk 66. Spark disk 66 has the conventional corrugations or knurls for augmenting the friction between itself and flint 58.

A driver disk 68 is fixedly connected to spark disk 66. Disks 66, 68 are rotatably attached to the top of plate 14. Thus, selective spinning of driver disk 68 causes a spinning of spark disk 66. Moreover, driver disk 68 is knurled in a conventional manner so that, in the lid open position, it may be selectively rotated, causing spark disk 66 to move against flint 58, thereby creating a spark to ignite fuel that is released from the reservoir. The diameter of driver disk 68 is larger than the diameter of spark disk 66 so as to increase the leverage advantage when driver disk 68 is selectively rotated.

Figure 1:
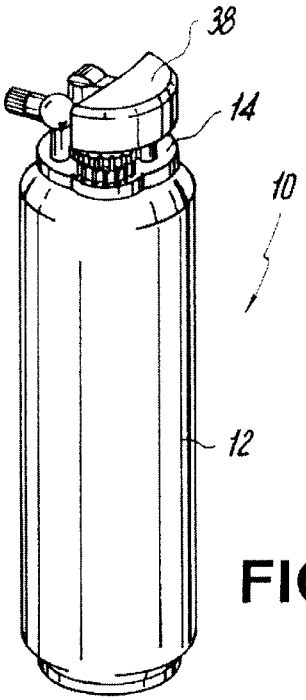
FIG. 1 is a perspective view of the preferred embodiment of the lighter of the invention with the driver disk covered by the lid.
Figure 2:
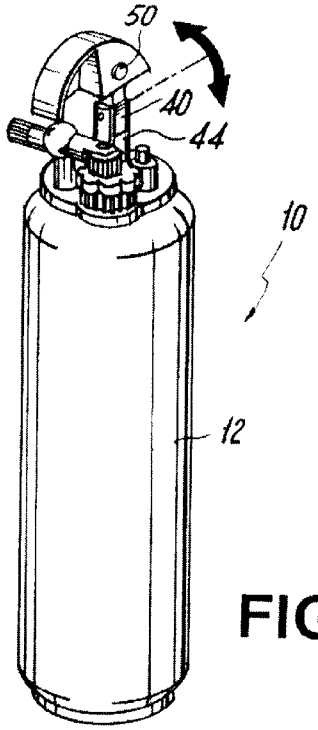
FIG. 2 is a perspective view of the lighter with the driver disk exposed.
Figure 3:
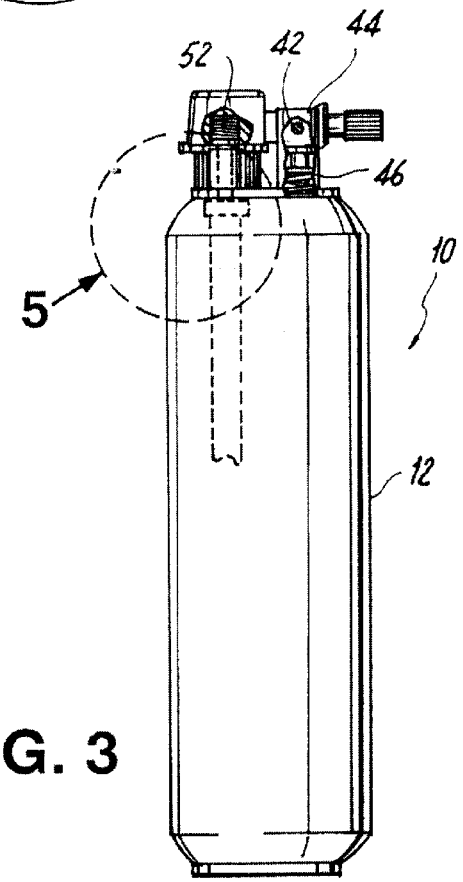
FIG. 3 is a side elevation view, partially broken away, of the lighter with the driver disk covered by the lid.
Figure 4:
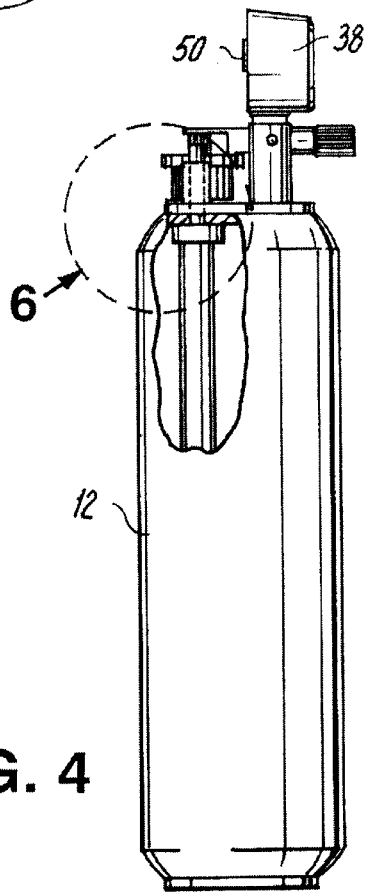
FIG. 4 is a side elevation view, partially broken away, of the lighter with the driver disk exposed.

In the preferred embodiment, the underside of lid 38 has an open area 72 for covering flint 58 and spark disk 66 when lid 38 is moved to the closed position (FIG. 3). Moreover, spring 46 is stiff enough to hinder the selective rotation of lid 38 from the closed position to the opened position and vice versa.

A third disk 70 is rotatably connected to housing 12 and is disposed between driver disk 68 and spark disk 66. Third disk 70 freely spins about the axle connecting spark disk 66 to driver disk 68. Disk 70 is relatively thin compared to driver disk 68, and has a diameter that is slightly larger than that of driver disk 68, for example 10% larger than the diameter of driver disk 68. Disk 70 is preferably made of metal or some similarly rigid non-flammable material that has a low coefficient of friction so that although it is between and engages one or both of spark disk 66 and driver disk 68, disk 70 can freely spin around the axle. The outer perimeter of disk 70 is preferably knurled, as shown in FIGS. 7 and 8, although the outer perimeter may be smooth.

Top plate 14 includes a radially outwardly protruding arcuate portion 74 between housing 12 and driver disk 68. Portion 74 extends radially outward a slightly greater distance than driver disk 68 as shown in FIGS. 7 and 8. Portion 74 preferably aligns with disk 70 to restrict or limit access to driver disk 68. Thus, one needs to make a concerted effort to place the fleshy bottom portion of their thumb (or other finger) on driver disk 68 to cause it to rotate. Most young children lack sufficient fleshy tissue in their thumbs and fingers to cause the driver disk 68 to rotate.

In use, after lid 38 is moved to the opened position, the user ignites a flame by rotating driver disk 68, thereby rotating spark disk 66 against flint 58 (FIG. 8). Because third disk 70 is larger than driver disk 68, disk 70 is contacted by the finger of the user prior to driver disk 68 being contacted. Disk 70 will spin freely thereby influencing the user's finger to slip off of the lighter and bypass driver disk 68. Similarly, because arcuate portion 74 of plate 14 protrudes radially out beyond driver disk 68, the finger of the casual user will follow the contour of portion 74, thereby further influencing the user's finger to slip off of the lighter and to bypass driver disk 68. To operate the lighter, the thumb of the physically mature user must be precisely positioned so that the fleshy part of the thumb can engage driver disk 68 and thereby avoid the slipping influence of safety disk 70 and arcuate portion 74 of plate 14.

When a child operates the lighter in an effort to mimic an adult and create a flame, safety disk 70 and arcuate portion 74 will make it quite difficult, or even impossible, for the child, with an insufficiently fleshy thumb or finger, to rotate the driver disk 68 and thereby operate the lighter and create a potentially dangerous flame. In addition, unlike an adult user, the child will not appreciate the importance of directing his/her grip toward the smaller diameter driver disk 68 as compared to directing the grip toward the larger diameter freely spinning safety disk 70 and the radially protruding arcuate portion 74, which the child's finger or thumb should come into contact with first. Due to the short attention span of the child and the obstacles in operating the lighter created by the use of safety disk 70 and arcuate portion 74, it is more likely that the child will be caused to lose interest in operating the lighter before a flame is created.

While various descriptions of the present invention were described above, it is within the knowledge of one of ordinary skill in the art to use the various features of the present invention singly or in any combination thereof. Therefore, this invention is not to be limited to only the specifically preferred embodiments depicted therein.

What is claimed is:

1. A lighter comprising:

a housing fonning a fuel reservoir; said housing having a fuel outlet extending from said housing; a valve assembly mounted within said fuel outlet for controlling the flow of fuel from within the reservoir to exterior of said fuel outlet;

a flint mounted on a top plate of said housing for lighting fuel released from said fuel reservoir;

a flint actuator comprising a spark disk to engage said flint and a driver disk fixedly connected to said spark disk;

a third disk being rotatably connected to said top plate and being disposed between said driver disk and said spark disk, said third disk having a diameter greater than said driver disk; and said top plate being fixedly connected to said housing, said top plate being disposed between said driver disk and said housing, said spark disk and said driver disk being rotatably connected to said top plate, said top plate having a radially outwardly protruding portion between said housing and said driver disk, said radially outwardly protruding portion being aligned with said driver disk and extending radially outwardly a greater distance than said driver disk.

2. The lighter of claim 1, wherein said third disk has a diameter that is at least 10% greater than that of said driver disk.

3. The lighter of claim 2, wherein said radially outwardly protruding portion being aligned axially with said third disk.

4. The lighter of claim 3, wherein said radially outwardly protruding portion is arcuate in shape.

5. The lighter of claim 1, wherein said radially outwardly protruding portion is arcuate in shape.

6. The lighter of claim 1, said driver disk and said spark disk have knurled outer surfaces.

7. The lighter of claim 1, further comprising a spring biased lid pivotally connected to said housing, said lid moving between an open position and a closed position, said lid including a hollow section covering said flint actuator when said lid is in said closed position.

8. The lighter of claim 7, wherein said valve assembly comprises an inner pipe and an outer pipe, said inner pipe being disposed within said outer pipe and being axially moveable between a fuel released position and a fuel blocked position, said outer pipe being fixedly connected to said housing, in said lid open position, said spring biasing said inner pipe in an outward direction with respect to said housing whereby fuel is released from said reservoir, in said lid closed position, said lid engages said inner pipe to force said inner pipe into an inner position with respect to said housing to block fuel from being released from said fuel reservoir.

9. The lighter of claim 1, further comprising a mechanism for selectively advancing said flint toward said spark disk.

10. The lighter of claim 1, wherein said driver disk and said spark disk are fixedly connected to a common axle.

11. The lighter of claim 10, wherein said third disk is freely rotatably mounted about said common axle.

12. A lighter comprising:

a housing forming a fuel reservoir; said housing having a fuel outlet extending from said housing;

a valve assembly mounted within said fuel outlet for controlling the flow of fuel from within the reservoir to exterior of said fuel outlet;

a flint disposed on a top plate of said housing for lighting fuel released from said fuel reservoir;

a flint actuator comprising a spark disk to engage said flint and a driver disk fixedly connected to said spark disk; and said top plate being fixedly connected to said housing, said top plate being disposed between said driver disk and said housing, said spark disk and said driver disk being rotatably connected to said top plate, said top plate having a radially outwardly protruding portion between said housing and said driver disk, said radially outwardly protruding portion being aligned with said driver disk and extending radially outwardly a greater distance than said driver disk.

* * * * *